US011073149B2

(12) United States Patent
Beisel et al.

(10) Patent No.: US 11,073,149 B2
(45) Date of Patent: Jul. 27, 2021

(54) PRESSURE PUMP CONNECTING ROD MONITORING

(71) Applicant: Halliburton Energy Services, Inc., Houston, TX (US)

(72) Inventors: Joe A. Beisel, Duncan, OK (US); Justin L. Hurst, Healdton, OK (US); Dickey Charles Headrick, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 91 days.

(21) Appl. No.: 16/480,575

(22) PCT Filed: Feb. 24, 2017

(86) PCT No.: PCT/US2017/019471
§ 371 (c)(1),
(2) Date: Jul. 24, 2019

(87) PCT Pub. No.: WO2018/156152
PCT Pub. Date: Aug. 30, 2018

(65) Prior Publication Data

US 2019/0345921 A1 Nov. 14, 2019

(51) Int. Cl.
*F04B 51/00* (2006.01)
*F04B 53/14* (2006.01)
(Continued)

(52) U.S. Cl.
CPC ..... *F04B 51/00* (2013.01); *F04B 1/0404* (2013.01); *F04B 9/045* (2013.01); *F04B 15/02* (2013.01);
(Continued)

(58) Field of Classification Search
CPC ..... F04B 9/1045; F04B 1/0404; F04B 15/02; F04B 49/065; F04B 51/00; F04B 53/006;
(Continued)

(56) References Cited

U.S. PATENT DOCUMENTS 2,764,026 A 9/1956 Walter
6,882,960 B2 4/2005 Miller
(Continued)

FOREIGN PATENT DOCUMENTS

CN 204154396 U 2/2015

OTHER PUBLICATIONS

Howard, Brian. "Wireless connecting rod temperature rod measurements for reciprocating compressor monitoring." GE Energy. GER-4606 (2010), 12 pages.
(Continued)

*Primary Examiner* — Charles G Freay
(74) *Attorney, Agent, or Firm* — John Wustenberg; Baker Botts L.L.P.

(57) ABSTRACT

A system and method for the early detection of connecting rod bearing failures in pump power ends using temperature measurements is provided. The system may include a housing enclosing the pump power end, and a crankshaft, connecting rod, and crosshead all disposed within the housing, with the connecting rod coupled between the crankshaft and the crosshead. The system also includes a temperature sensor assembly at least partially disposed on the housing. The temperature sensor assembly is communicatively coupled to a controller located outside the housing, and the temperature sensor assembly is positioned such that the temperature sensor assembly detects a temperature of the connecting rod or the crosshead. A controller may read, store, and monitor temperature data received from the temperature sensor, and output an alert to an operator or shut
(Continued)

down the pump upon detecting a temperature that exceeds a predetermined threshold.

20 Claims, 7 Drawing Sheets

(51) Int. Cl.

| | |
|---|---|
| ***F04B 15/02*** | (2006.01) |
| ***F04B 53/00*** | (2006.01) |
| ***F04B 53/18*** | (2006.01) |
| ***F04B 1/0404*** | (2020.01) |
| ***F04B 9/04*** | (2006.01) |
| ***F04B 49/06*** | (2006.01) |

(52) U.S. Cl.
CPC ..... *F04B 49/065* (2013.01); *F04B 53/006* (2013.01); *F04B 53/144* (2013.01); *F04B 53/18* (2013.01); *F04B 2201/12* (2013.01)

(58) Field of Classification Search
CPC .... F04B 53/18; F04B 53/144; F04B 2201/12; F04B 2201/1207
See application file for complete search history.

(56) References Cited

U.S. PATENT DOCUMENTS

| | | | | |
|---|---|---|---|---|
| 6,964,518 | B1 | 11/2005 | Jagtoyen | |
| 7,623,986 | B2 | 11/2009 | Miller | |
| 8,966,967 | B2 | 3/2015 | Wiebrecht et al. | |
| 2002/0172604 | A1* | 11/2002 | Berger | F04B 49/035 417/307 |
| 2010/0300683 | A1 | 12/2010 | Looper et al. | |
| 2014/0331753 | A1* | 11/2014 | Wiebrecht | F16C 17/243 73/114.81 |
| 2016/0208794 | A1* | 7/2016 | Singh | F04B 49/065 |
| 2017/0373766 | A1* | 12/2017 | Lee | G08C 17/00 |

OTHER PUBLICATIONS

International Search Report and Written Opinion issued in related PCT Application No. PCT/US2017/019471 dated Oct. 31, 2017, 17 pages.

* cited by examiner

PRESSURE PUMP CONNECTING ROD MONITORING

CROSS-REFERENCE TO RELATED APPLICATION

The present application is a U.S. National Stage Application of International Application No. PCT/US2017/019471 filed Feb. 24, 2017, which is incorporated herein by reference in its entirety for all purposes.

TECHNICAL FIELD

The present disclosure relates generally to high pressure pump power ends, and more particularly, to systems and methods for monitoring connecting rod bearings and crosshead bearings in a high pressure pump power end.

BACKGROUND

Variable stroke piston-type and plunger-type positive displacement pumps are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations.

A typical positive displacement pump will include at least one piston or plunger arranged to move in reciprocating fashion within a piston cylinder by means of a conventional crankshaft and connecting rod assembly. One end of the connecting rod is coupled to the crankshaft via a bearing, while the opposite end of the connecting rod is coupled to a crosshead via another bearing. Lubrication of the power end components of the positive displacement pump is generally provided to reduce friction, reduce friction-related heat, remove particulate matter, and, thereby, improve the life and/or minimize failure of large pump system components.

Unfortunately, undetected damage to the bearings in the pump power end can cause the connecting rod to fail, which can then lead to a worsening situation in the pump until a catastrophic failure of the pump power end occurs. Fixing the pump power end after unexpected failures such as this can be expensive and time consuming, as the pump system may be shut down suddenly and broken internal components of the pump may breach the pump power end housing. It is recognized that reliable methods for identifying a failing bearing on a pump power end connecting rod or crosshead are desired.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
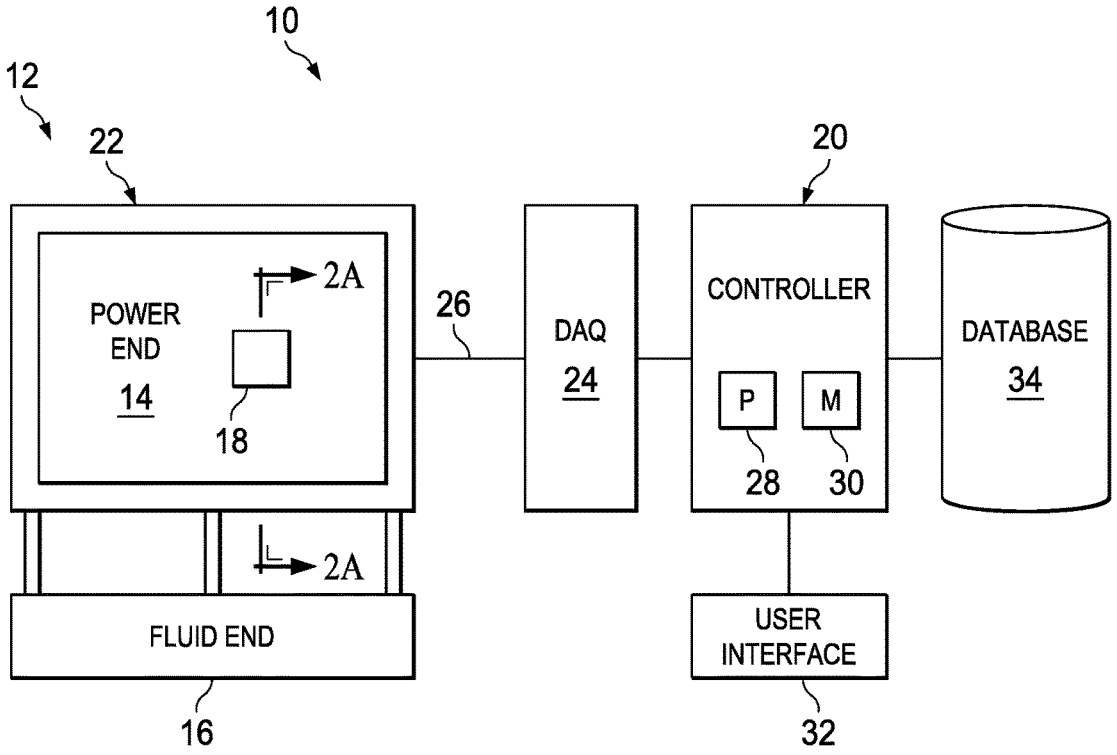
FIG. 1 is a diagram illustrating a system for monitoring bearing health in a pressure pump power end, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The terms "couple" or "couples" as used herein are intended to mean either an indirect or a direct connection. Thus, if a first device couples to a second device, that connection may be through a direct connection, or through an indirect mechanical or electrical connection via other devices and connections. The term "fluidically coupled" or "in fluid communication" as used herein is intended to mean that there is either a direct or an indirect fluid flow path between two components.

The present disclosure is directed to a system and method for eliminating catastrophic pump power end failures due to semi journal bearing failures on a connecting rod. Typical existing methods of bearing condition monitoring revolve around taking vibration measurements and comparing them to a baseline. Unfortunately, such methods have proven difficult for use on reciprocating machinery. This is because typical vibration based condition monitoring techniques are not as effective with high mass, low speed machinery like reciprocating pump power ends.

To overcome these drawbacks, the disclosed system and method may predict catastrophic pump power end failures due to connecting rod bearing failures by the use of temperature measurements, as opposed to vibration measurements. While temperature measurements have been used to determine bearing health in general, it is challenging to apply temperature-based bearing monitoring techniques to the area of connecting rod and crosshead bearings of a pump. This is because the connecting rod and the crosshead are each in constant motion within the pump power end housing.

One option for providing temperature measurements for evaluating bearing health in the pump power end environment is to mount temperature sensors directly onto the connecting rod (and/or crosshead). These temperature sensors may be connected to a monitoring system outside the pump by either flexible wires that can withstand bending due to movement of the internal connecting rod/crosshead or some sort of wireless communication system. If wireless communication is used, the temperature sensors may be supplied with power via a power source inside the pump power end. In some embodiments, for example, the temperature sensors may be powered by pump motion or other mechanical means of power generation.

Another option for providing temperature measurements for evaluating bearing health in a pump power end is through the use of non-contact temperature measurement. For example, the disclosed systems may provide non-contact temperature measurements in the form of infrared sensor measurements or thermal imaging. The system may employ an infrared non-contact temperature sensor aimed directly at all points on the connecting rod or crosshead where the temperature is to be determined.

These and other types of temperature measurement systems and methods may be utilized in the pump power end to take temperature measurements of the connecting rod or crosshead near the bearing connections. The detected temperature measurements may then be communicated from the internal temperature sensors to a controller located external to the pump power end. The controller may read, store, and compare the various temperature sensor data, and the controller may output an alert to an operator or shut down the pump upon detecting a temperature that exceeds a predetermined threshold. That way, the system can shut down the pump before any catastrophic pump failure occurs in response to damage to one or more bearings at the connection rod or crosshead. An operator would then simply provide routine maintenance to replace pump system bearings or other small components, without the costly and time consuming repairs associated with catastrophic pump end failure. In addition, in embodiments where temperature measurements are provided to the controller continuously over a long period of time, the temperature measurements may be stored and monitored to track the decay of pump equipment over time.

Turning now to the drawings, FIG. 1 is a block diagram representing a system 10 for monitoring bearing health in a reciprocating pump 12. The pump 12 may generally include a power end 14 and a fluid end 16. The power end 14 of the pump 12 may include several mechanical components such as a crankshaft, multiple connecting rods coupled to the crankshaft, and multiple crossheads each coupled to one of the connecting rods. The crossheads are connected to reciprocating pistons or plungers that apply pressure to pump fluid through the fluid end 16. The power end 14 generally converts rotational mechanical energy from the crankshaft into reciprocating movement of the multiple reciprocating pistons or plungers to pump fluid through the fluid end 16.

The system 10 may utilize a temperature sensor assembly 18 to detect the temperature of one or more bearings disposed in a power end 14 of the pump 12. The bearings may be located at the interface between the crankshaft and the connecting rod or at the interface between the connecting rod and the crosshead. The temperature sensor assembly 18 may include one or more temperature sensors, which may be contact sensors or non-contact sensors, disposed in the power end 14 to detect a temperature at the desired bearing locations. Examples of various types of temperature sensor assemblies 18 that may be utilized in the disclosed system 10 are described in detail below with reference to FIGS. 2A, 2B, and 6-11.

As illustrated, the temperature sensor assembly 18 may be communicatively coupled to a controller 20 located external to a housing 22 of the pump power end 14. The temperature sensor assembly 18 may be at least partially disposed within the housing 22 of the pump end 14 so that the temperature sensor is able to take temperature measurements of the bearing components enclosed within the power end housing 22 and to communicate the temperature measurements to the controller 20 disposed outside the housing 22. The system 10 may further include a data acquisition (DAQ) system 24 coupled between the temperature sensor assembly 18 and the controller 20. In some instances, the DAQ system 24 may be used to communicate sensor signals from multiple distributed sensor assemblies on the pump 12 or a plurality of pumps 12 to the controller 20. Cabling 26 (or wireless communication techniques) may be used between the controller 20, DAQ system 24, and temperature sensor assembly 18 in the pump power end 14 to communicate data, control signals, and power between the system components.

The controller 20 utilizes at least a processor component 28 and a memory component 30 to monitor and/or control various operations at the pump 12. For example, one or more processor components 28 may be designed to execute instructions encoded into the one or more memory components 30. Upon executing these instructions, the processors 28 may analyze signals received from the temperature sensor assembly 18 to monitor the health of bearings disposed in the pump power end 14. The processors 28 may output control signals to a user interface 32 in response to certain signals received from the temperature sensor assembly 18 and/or DAQ system 24. For example, the processor 28 may compare the detected temperature measurements received at the controller 20 to a predetermined threshold and, if the detected temperature exceeds the threshold, the processor 28 may output a signal to the user interface 32 to output an alert to an operator. In some embodiments, the processor 28 may output a control signal to the power end 14 to shut off pump operation if a detected temperature signal exceeds the temperature threshold indicating that a bearing is failing. The controller 20 may be communicatively coupled to a database 34, as shown, and the processor 28 may send temperature measurement signals to the database 34 for storage throughout pump operation. The processor 28 may perform various trend analyses on the temperature measurement data stored in the database 34 over a period of time in which the pump 12 is in operation.

Figure 2A:
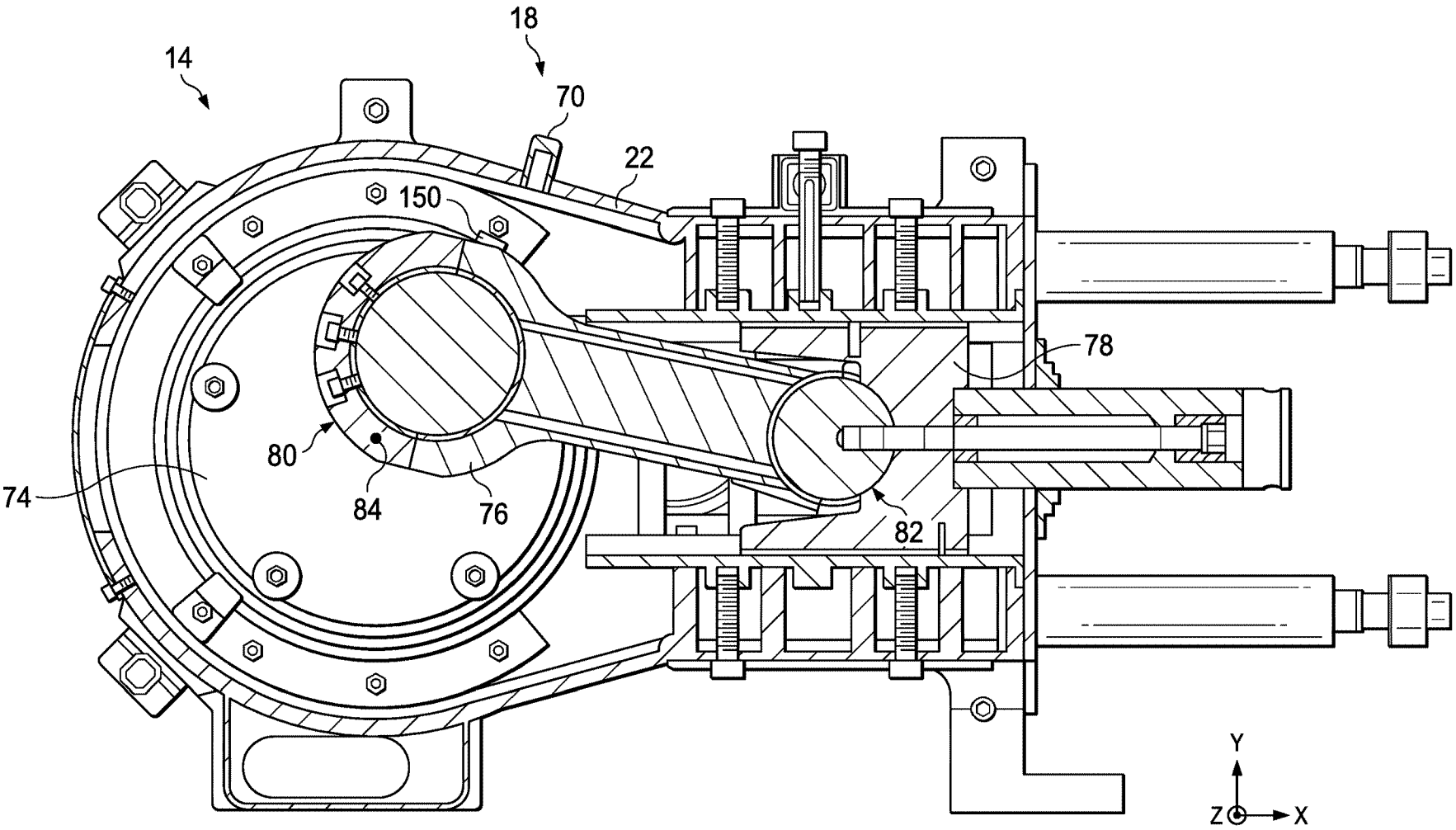
FIGS. 2A and 2B are cross sections of the pressure pump power end taken along line A-A of FIG. 1 and having one or more infrared sensors for monitoring bearing health, in accordance with an embodiment of the present disclosure.
Figure 2B:
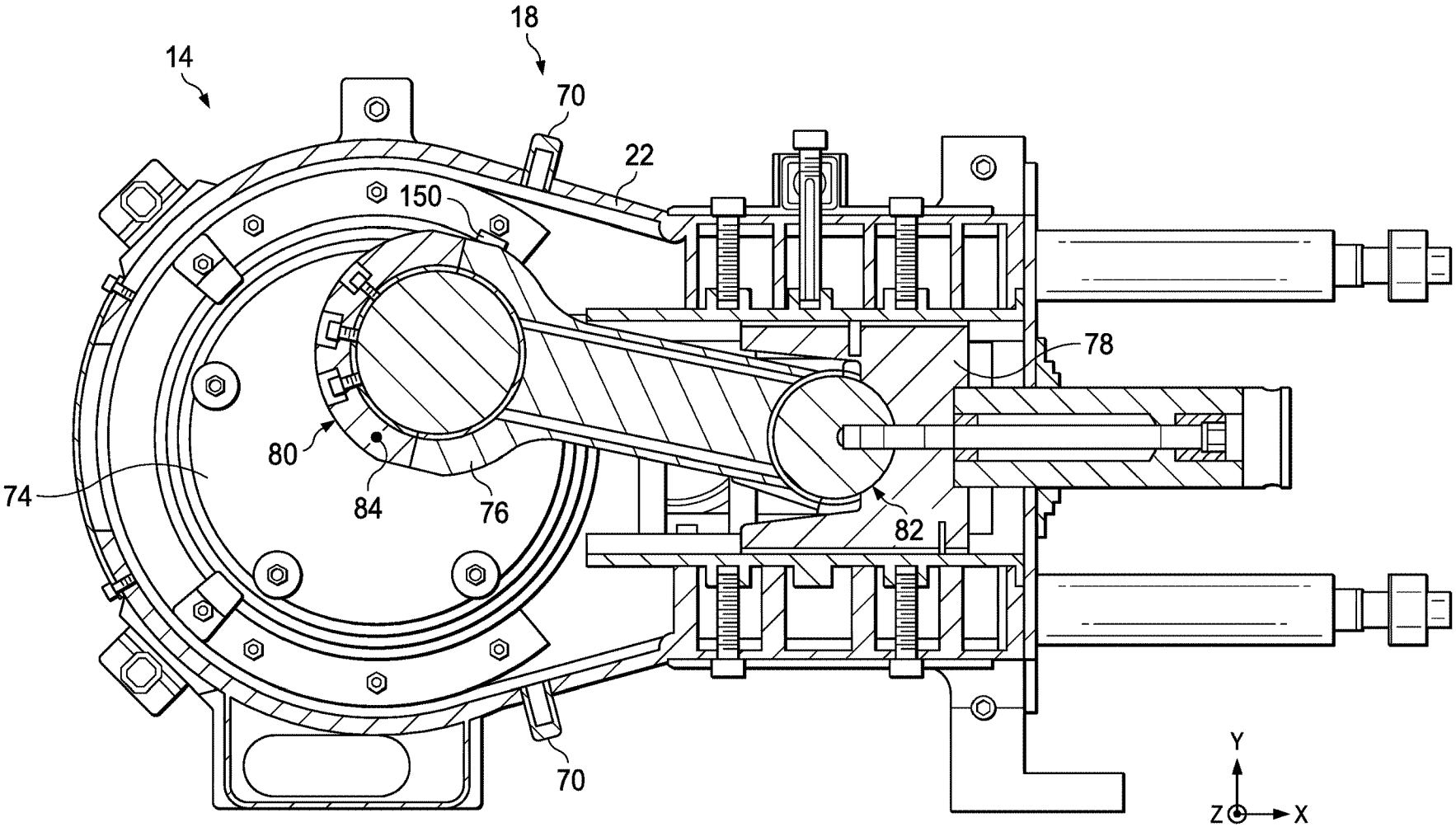

Having now described a general overview of the system 10 for monitoring bearing health using a temperature sensor assembly 18 disposed in the pump power end 14, a more detailed description of an example temperature sensor assembly 18 will be provided. FIGS. 2A and 2B illustrate the power end 14 of a reciprocating pump 12 having a temperature sensor assembly 18 that uses a non-contact temperature sensor 70.

FIGS. 2A and 2B illustrate the inner workings of the disclosed pump power end 14. As mentioned above, the power end 14 includes the housing 22, a crankshaft 74, a connecting rod 76 coupled to the crankshaft 74, and a crosshead 78 coupled to the connecting rod 76. The crankshaft 74 is disposed in the housing 22, and both the connecting rod 76 and the crosshead 78 are enclosed within the housing 22. As illustrated, a first end 80 of the connecting rod 76 is coupled to the crankshaft 74, and the crosshead 78 is coupled to a second end 82 of the connecting rod 76 opposite the first end 80.

Bearings are located on the first end 80 of the connecting rod 76 to support the connecting rod 76 in a desired plane of movement between the crankshaft 74 and the crosshead 78 while the crankshaft 74 rotates about a shaft axis 84 (parallel to Z-axis). Bearings are similarly located on the crosshead 78 to support the rotating second end 82 of the connecting rod 76 as the crosshead 78 moves in a direction of the X-axis. As described above, either of these sets of bearings may become damaged during regular use of the pump power end 14 and, if not fixed or replaced in a reasonable amount of time, may lead to larger system pump failures.

Abnormally high temperatures of the first end 80 of the connecting rod 76 can indicate that a connecting rod bearing at the interface of the connecting rod 76 and the crankshaft 74 is damaged. Similarly, high temperatures of the crosshead 78 can indicate that a crosshead bearing at the interface of the connecting rod 76 and the crosshead 78 is damaged. The temperature sensor assembly 18 may be disposed in the power end 14 to detect a temperature at the first end 80 of the connecting rod 76, the crosshead 78, or both.

In the illustrated embodiment, the temperature sensor assembly 18 includes a non-contact temperature sensor 70, which is mounted on the housing 22 of the power end 14. The non-contact temperature sensor 70 may include a passive infrared sensor having an infrared receiver used to detect electromagnetic energy emitted from a target component (e.g., connecting rod 76 or crosshead 78) at infrared wavelengths. In other embodiments, the non-contact temperature sensor 70 may include an infrared sensor having a transmitter for transmitting infrared or other wavelength energy toward the target component (e.g., connecting rod 76 or crosshead 78) and a receiver for detecting electromagnetic energy reflected back from the target component.

As shown, the non-contact temperature sensor 70 may be disposed on and pointed inward from the housing 22 to detect a temperature of the connecting rod 76, which is indicative of the temperature of the bearings at the interface of the first end 80 of the connecting rod 76 and the crankshaft 74. In other embodiments, the non-contact temperature sensor 70 may be positioned to detect a temperature of the crosshead 78, which is indicative of the temperature of the bearings at the interface of the crosshead 78 and the second end 82 of the connecting rod 76. In still other embodiments, the temperature sensor assembly 18 may include two non-contact sensors 70, each mounted to the housing 22, with one positioned to take temperature measurements of the connecting rod bearings and the other positioned to take temperature measurements of the crosshead bearings.

FIG. 2B illustrates an embodiment of the pump power end 14 having a temperature sensor assembly 18 that uses multiple non-contact temperature sensors 70. For example, the temperature sensor assembly 18 may include two non-contact temperature sensors 70, one disposed on either side of the area where the connecting rod 76 is connected to the crankshaft 74. This may be particularly useful for enabling the detection of temperature at the connecting rod 76/crankshaft 74 interface in instances where a relatively longer connecting rod 76 and relatively shorter crankshaft 74 are used. In addition, this positioning of multiple sensors 70 around the same bearing location at the first end 80 of the connecting rod 76 may provide redundant temperature measurements to the controller (e.g., 20 of FIG. 1), which may then use the multiple measurements for verification. Similarly, multiple non-contact sensors 70 may be mounted to the housing 22 of the pump end 14 and positioned such that they take measurements of different points around the crosshead 78 where the crosshead 78 interfaces with the connecting rod 76.

Since it utilizes one or more non-contact sensors 70 such as infrared sensors mounted directly to the pump housing 22, the temperature sensor assembly 18 may be relatively easy to install onto existing pump power ends 14. That is, one or more infrared or other non-contact temperature sensors 70 may be simply inserted into an opening formed in the housing 22, calibrated for taking the desired temperature measurements, and communicatively coupled to the DAQ system (e.g., 24 of FIG. 1) and/or controller (e.g., 20 of FIG. 1). In addition, since the infrared or other non-contact sensors 70 are mounted directly to the housing 22 and do not contact the rotating machinery inside the housing 22, the sensors 70 may receive uninterrupted power from a power source and output uninterrupted transmissions of sensor data to the controller 20 via the cabling (e.g., 26 of FIG. 1). This enables the one or more sensors 70 to provide more data to the controller 20 than would otherwise be available using a sensor that intermittently contacts the machinery for collecting measurements or only transmits data when it is within a certain temperature range.

In the context of using one or more non-contact sensors 70, the sensors may not directly take measurements of the actual temperature of the internal components in the power end 14. Instead, the sensors 70 may detect electromagnetic energy at infrared or other frequencies emitted or reflected from the target component (e.g., connecting rod or crosshead) and send the data to the controller 20 for determination of an approximate temperature of the component based on the heat it is radiating. Thus, the controller 20 of FIG. 1 may receive sensor data indicative of connecting rod or crosshead temperature from the sensor assembly 18 (e.g., non-contact sensors 70 of FIG. 2), determine a corresponding temperature measurement, and upon the detected temperature measurement exceeding a predetermined threshold, output a signal to alert an operator via the user interface 32.

Figure 3:
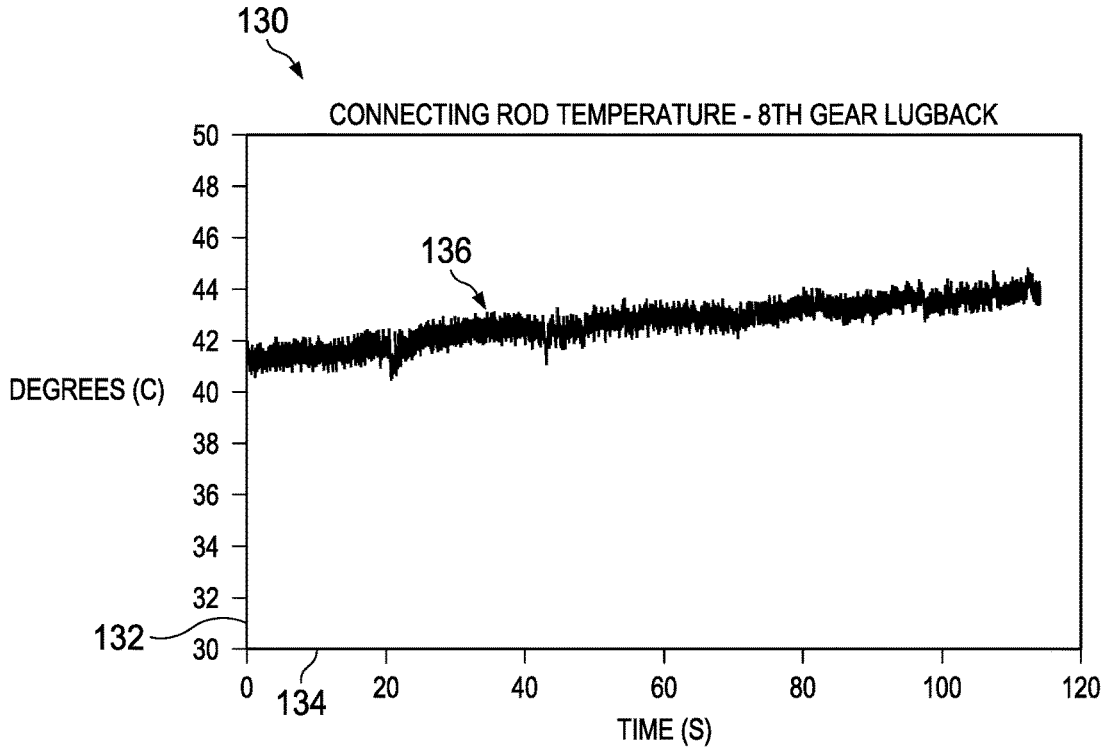
FIG. 3 is a plot of infrared sensor measurements for monitoring bearing health in a pressure pump power end, in accordance with an embodiment of the present disclosure.

FIG. 3 is a plot 130 illustrating the results of a preliminary trial performed using a non-contact infrared sensor (e.g., sensor 70 of FIG. 2A) to detect a temperature of a connecting rod (e.g., connecting rod 76 of FIG. 2A) in a pump power end. Specifically, the plot 130 illustrates a detected temperature 132 of the connecting rod 76 plotted against time 134. A trend line 136 representing the temperature 132 of the connecting rod 76 taken with respect to time 134 is shown on the plot 130. The results of the preliminary trial illustrated in the plot 130 show a reasonable progression of temperature measurements of the connecting rod 76, as the temperature 132 gradually increases over time 134 as expected during the brief test. As described above with reference to FIG. 1, once the measured temperature 132 of the connecting rod 76 increases above a predetermined level, the controller may send an alarm to an operator to alert the operator to a possibly damaged bearing component that needs to be replaced.

Turning back to FIGS. 2A and 2B, it should be noted that when using one or more non-contact sensors 70 to provide temperature measurements, a dynamic oil film present on the mechanical pump components may impede the measurements to a certain extent. This dynamic oil film is a continuously flowing layer of oil used to lubricate the connecting rod 76, the crosshead 78, associated bearings, the crankshaft 74, and other mechanical components of the power end 14. Such a thin film of oil may be somewhat transparent to infrared wavelengths, such as those emitted or reflected from the target component (e.g., connecting rod 76 or crosshead 78). That way, the non-contact sensors 70 may be able to effectively detect an approximate temperature of the connecting rod 76 or the crosshead 78 through the thin layer of lubricating oil.

Some lubricating oils may be more transparent at certain energy wavelengths than others. As such, it may be desirable to calibrate or tune the wavelength of energy transmitted or received by the non-contact sensor 70 based on the particular oil being used. That way, the non-contact sensor 70 outputs an accurate measurement of the temperature of the connecting rod 76 or crosshead 78 for the particular pump. In some embodiments, a target material 150 may be disposed on the connecting rod 76 (or crosshead 78) to provide a stronger target for the non-contact sensor 70. For example, the target material 150 may be a certain material that emits or reflects energy at wavelengths that can easily pass through the oil layer on the connecting rod 76 or crosshead 78 for detection by the non-contact sensor 70.

In some instances, the non-contact sensor 70 may just detect the energy reflected or emitted from the oil layer that is indicative of the temperature of the oil (as opposed to the exact temperature of the connecting rod 76 or crosshead 78). However, the energy detected by the non-contact sensor 70 may still offer an effective approximation of the temperature of the connecting rod 76 or crosshead 78 under the oil. Additionally, by detecting the energy radiating from the oil, the non-contact sensor 70 may provide measurements to the controller that are useful in determining when the temperature of the connecting rod 76 or the crosshead 78 has exceeded a normal operating threshold. This is because once the temperature of the connecting rod 76 or crosshead 78 gets too high, the layer of oil becomes less effective or ineffective at lubricating the components. The increase in temperature may change the consistency of the oil layer and, as a result, the amount of energy radiating therefrom that is detected by the sensor 70.

In embodiments of the pump power end 14 with the temperature sensor assembly 18 having a non-contact temperature sensor 70, as described in reference to FIGS. 2A and 2B, it may be desirable to utilize multiple non-contact temperature sensors 70 disposed at different positions around the housing 22 and each detecting a temperature at a different location of the connecting rod 76 or crosshead 78. That way, each of the sensors 70 may communicate their detected results to the controller (e.g., 20 of FIG. 1), which uses the sensor measurements to determine which, if any, of the bearings on the connecting rod 76 or crosshead 78 are damaged and need to be replaced.

Figure 4:
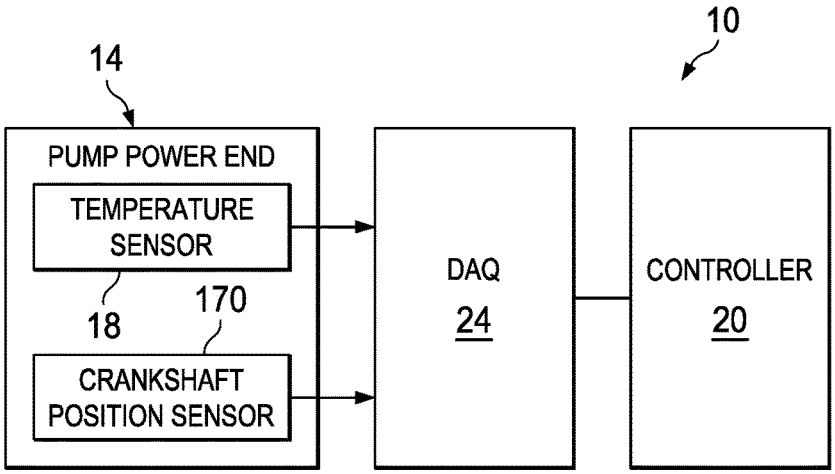
FIG. 4 is a diagram illustrating a system for monitoring bearing health in a pressure pump power end, in accordance with an embodiment of the present disclosure.

In other embodiments, the pump power end 14 may utilize a temperature sensor assembly 18 with just one temperature sensor (e.g., non-contact temperate sensor 70) and a position sensor 170, as shown in FIG. 4. The position sensor 170 may detect the rotational position of the crankshaft of the power end 14 and, consequently, the position of the connecting rod and/or crosshead. As shown, the temperature sensor assembly 18 and the crankshaft position sensor 170 are both communicatively coupled to the DAQ system 24 and the controller 20 to provide this temperature and position information to the controller 20. The controller 20 may utilize both the temperature sensor data and the position sensor data to determine which, if any, of the specific bearings on the connecting rod 76 or crosshead 78 are damaged and need to be replaced. For example, the controller 20 may analyze the data to determine which end of the connecting rod or crosshead is hotter, pinpointing the bearing with the problem using only one temperature sensor for a single connecting rod.

Figure 5:
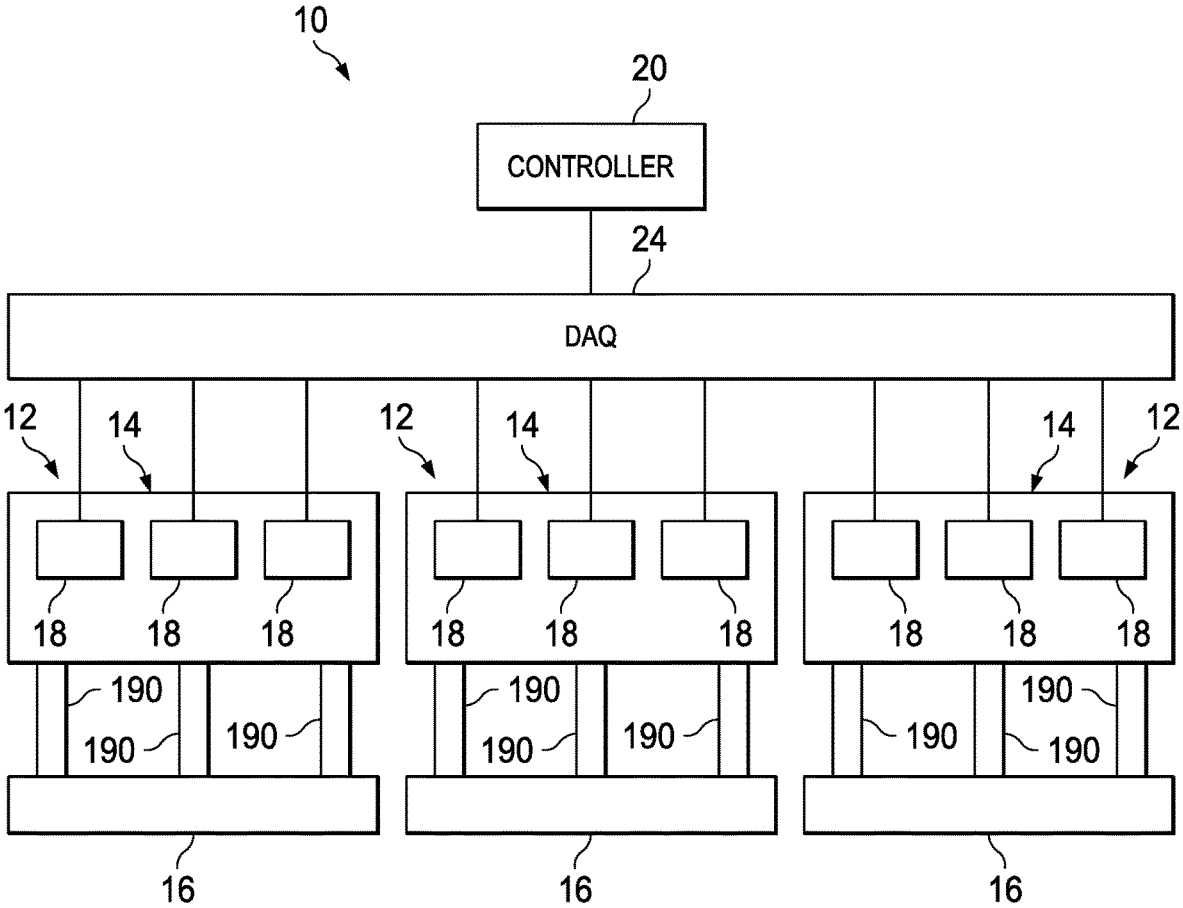
FIG. 5 is a diagram illustrating a system for monitoring bearing health across multiple pressure pumps, in accordance with an embodiment of the present disclosure.

FIG. 5 illustrates an embodiment of the disclosed pump system 10 that includes multiple reciprocating pumps 12 equipped with temperature sensor assemblies 18. As shown, the pumps 12 may each include multiple pump sections 190. Each pump section 190 corresponds to one reciprocating piston or plunger and includes a connecting rod and crosshead coupled to the crankshaft of the pump power end 14. In the illustrated embodiment, each pump 12 includes three sections 190. However, other numbers of pump sections (e.g., 4, 5, 6, or more) may be present in other pumps 12. As shown, each pump power end 14 may be equipped with multiple temperature sensor assemblies 18, one corresponding to the connecting rod/crosshead for each pump section 190.

All of the temperature sensor assemblies 18 for a given pump power end 14 may be communicatively coupled to the DAQ system 24 and/or the controller 20. The controller 20 may compare the temperature readings across each of the temperature sensor assemblies 18 in a given power end 14. In addition, all of the temperature sensor assemblies 18 used on the multiple pumps 12 may be communicatively coupled to the DAQ system 24 and the controller 20, as shown in FIG. 5. The controller 20 may compare the temperature readings from each of the temperature sensor assemblies 18 across all the multiple reciprocating pumps 12. Specifically, the controller 20 may perform statistical comparisons to determine if one connecting rod/crosshead is running hotter than the other connecting rods/crossheads of a given power end 14 (or across all the pumps 12) under the same loading conditions. If one connecting rod/crosshead is running hotter, this may indicate a lubrication issue or other issue that is present within the pump system 10. This problem may be statistically detectable through the comparisons made by the controller 20 before the readings from any individual temperature sensor assemblies 18 reach the predetermined threshold for indicating a damaged bearing. For example, the controller 20 may alert an operator when the temperature readings from one or more of the individual pump sections 190 is within the normal range of expected temperatures but is noticeably higher than the temperature readings from the other pump sections 190. This type of early detection may be particularly useful as it enables detection of a more manageable problem (e.g., lubrication) with the pump power end 14 before a bearing actually becomes damaged and requires replacement. The controller may also perform various trending analyses on the temperature data received from the multiple temperature sensor assemblies 18 for each pump 12 as well as for all of the pumps 12 in the system 10.

While temperature sensor assemblies 18 utilizing one or more non-contact temperature sensors are described above, other embodiments of the temperature sensor assemblies 18 may be utilized in the disclosed system 10. FIGS. 6-11 illustrate other types of temperature sensor assemblies 18 that may be used in the pump power ends 14 of reciprocating pumps 12 to measure a temperature of the connecting rod 76 or crosshead 78 of a pump section. Each of these temperature sensor assemblies 18 in FIGS. 6-11 may include contact temperature sensors, such as a thermocouple that is either mounted directly to the connecting rod 76 or crosshead 78, or is periodically brought into sensing contact with the connecting rod 76 or crosshead 78. As described above, at least a portion of the temperature sensor assemblies 18 may be mounted to or disposed through the housing 22 of the pump end 14, thereby allowing the temperature sensor assembly 18 to be communicatively coupled to the controller located outside the housing 22. The temperature sensor assemblies 18 described in detail below may be used in the pump systems 10 of FIGS. 1, 4, and 5 of the present disclosure.

Figure 6:
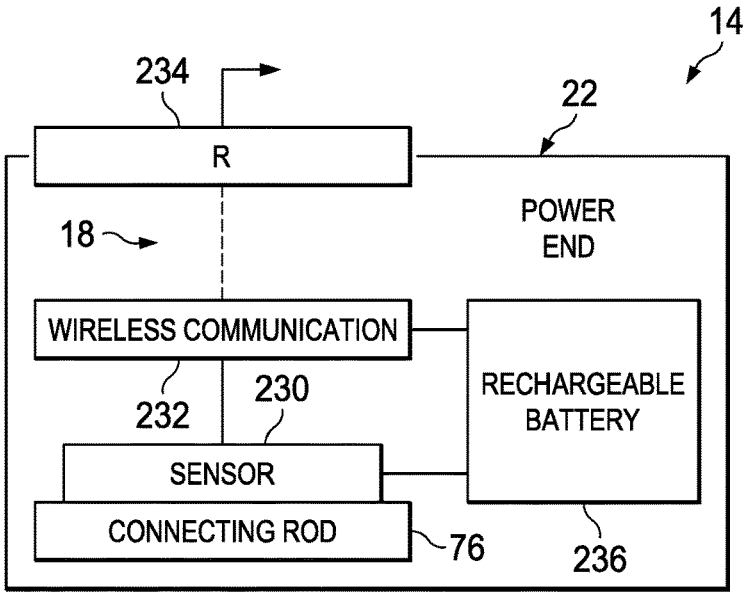
FIG. 6 is a diagram illustrating a sensor arrangement for monitoring bearing health in a pressure pump power end, in accordance with an embodiment of the present disclosure.

FIG. 6 illustrates an example temperature sensor assembly 18 having a temperature sensor 230, a wireless transmitter 232, a wireless receiver 234, and a rechargeable battery 236. The temperature sensor 230 may be mounted directly onto the connecting rod 76 (or the crosshead in other instances). The temperature sensor 230 may be coupled to or packaged together with the wireless transmitter 232, and the transmitter 232 may be designed to transmit temperature data collected by the temperature sensor 230 to the wireless receiver 234 via a wireless communication protocol. The wireless receiver 234 may be disposed on the housing 22 of the pump power end 14 so as to communicate signals received from the temperature sensor 230 and transmitter 232 inside the housing 22 to the controller located outside the housing 22. The transmitter 232 and the temperature sensor 230 may be powered by the rechargeable battery 236, which may be recharged by energy harvesting devices or electric fields in response to the movement of the connecting rod 76 within the power end 14. Multiple temperature sensors 230 and associated transmitters 232, receivers 234, and batteries 236 may be utilized in the pump power end 14 and positioned such that they take measurements of different points around the connecting rod 76 (or crosshead) for redundancy. Other embodiments of the temperature sensor assembly 18 may utilize a battery-less radar-based wireless communication system inside the housing 22 to communicate temperature sensor signals to a receiver in the housing 22.

Figure 7:
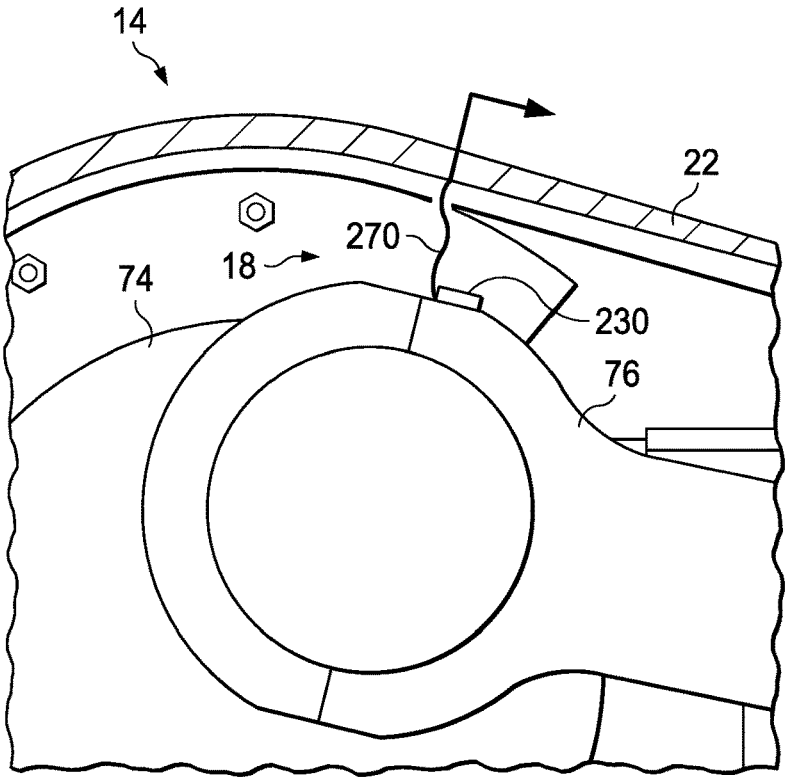
FIG. 7 is a diagram illustrating a sensor arrangement for monitoring bearing health in a pressure pump power end, in accordance with an embodiment of the present disclosure.

FIG. 7 illustrates an example temperature sensor assembly 18 having a temperature sensor 230 mounted on a distal end of a flexible member 270. The flexible member 270 is attached at one end to the housing 22, and the temperature sensor 230 is mounted to the distal end of the flexible member 270 extending from the housing 22. The flexible member 270 may include cabling for providing power to the temperature sensor 230 and communication of temperature data from the sensor 230 to the controller located outside the housing 22. The flexible member 270 enables the temperature sensor 230 to drag against the connecting rod 76 (or crosshead) as it comes by on each rotation of the crankshaft 74 (or each stroke of the crosshead). The temperature sensor 230 contacting the connecting rod 76 at each stroke of the pump may facilitate contact sensing of the connecting rod or crosshead temperature. Multiple temperature sensors 230 and associated flexible members 270 may be utilized in the pump power end 14 and positioned such that they take measurements of different points around the connecting rod 76 (or crosshead) for redundancy.

Figure 8:
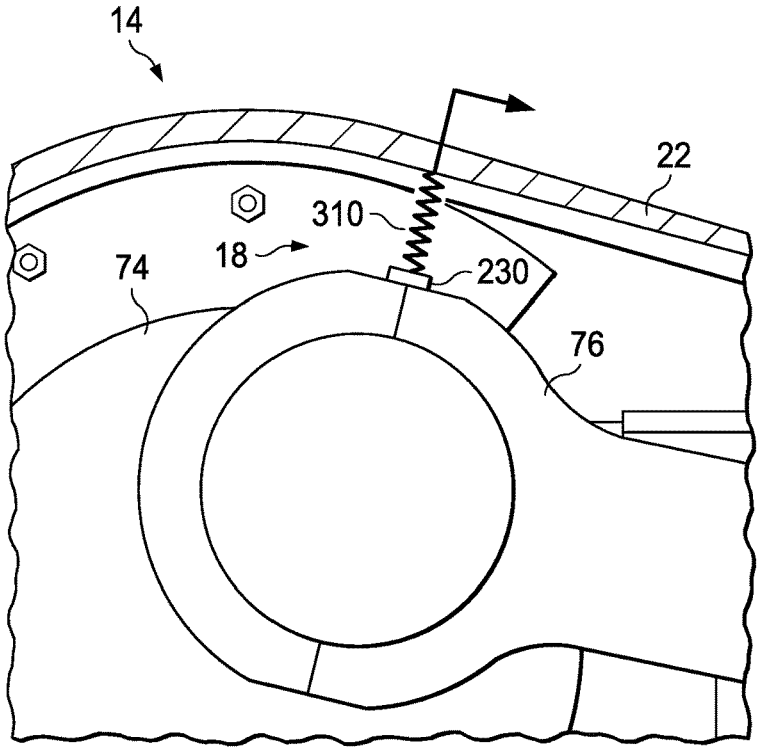
FIG. 8 is a diagram illustrating a sensor arrangement for monitoring bearing health in a pressure pump power end, in accordance with an embodiment of the present disclosure.

FIG. 8 illustrates an example temperature sensor assembly 18 having a temperature sensor 230 installed on the distal end of a spring-loaded retracting plunger 310. The spring-loaded retracting plunger 310 of the temperature sensor assembly 18 may be fastened to the housing 22, as shown, and the temperature sensor 230 may be installed at the end of the plunger 310 extending from the housing 22 toward the connecting rod 76. The spring-loaded retracting plunger 310 may include cabling for providing power to the temperature sensor 230 and communication of temperature data from the sensor 230 to the controller located outside the housing 22. The spring-loaded retracting plunger 310 enables the temperature sensor 230 to come into contact with the connecting rod 76 (or crosshead) as it comes by on each rotation of the crankshaft 74 (or each stroke of the crosshead). The temperature sensor 230 contacting the connecting rod 76 at each stroke of the pump may facilitate contact sensing of the connecting rod or crosshead temperature. Multiple temperature sensors 230 and associated spring-loaded plungers 310 may be utilized in the pump power end 14 and positioned such that they take measurements of different points around the connecting rod 76 (or crosshead) for redundancy.

In the temperature sensor assemblies 18 of FIGS. 7 and 8, the temperature sensors 230 may be designed to only take temperature readings when the sensor 230 is in direct contact with the connecting rod 76 (or crosshead). In other embodiments, the temperature sensors 230 may be designed to always collect and communicate temperature readings, and the controller may determine based on the temperature signals and/or position sensor data (e.g., FIG. 4) when the temperature sensor 230 is in contact with the connecting rod 76 (or crosshead) and analyze only the data collected when the sensor 230 is contacting the target component.

Figure 9:
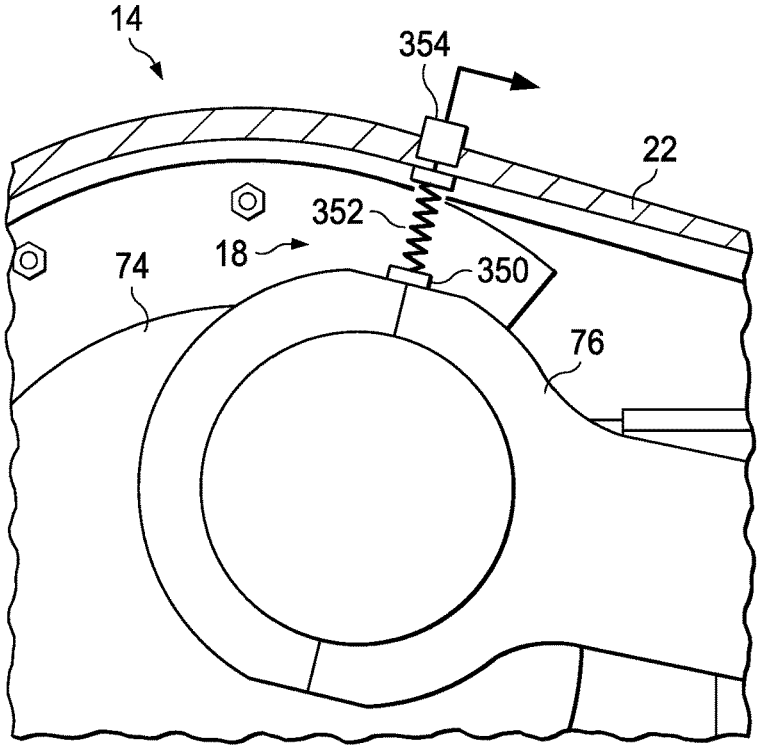
FIG. 9 is a diagram illustrating a sensor arrangement for monitoring bearing health in a pressure pump power end, in accordance with an embodiment of the present disclosure.

FIG. 9 illustrates an example temperature sensor assembly 18 having a thermal fuse device 350 and a spring-loaded mechanical plunger 352 mounted to the connecting rod 76 or crosshead. The temperature sensor assembly 18 also includes an electric switch 354 mounted on the housing 22 of the pump power end 14 opposite the spring-loaded mechanical plunger 352. The thermal fuse device 350 may include a wax cartridge or equivalent component that keeps the spring-loaded mechanical plunger 352 in a retracted position against the connecting rod 76 (or crosshead) until the connecting rod 76 (or crosshead) exceeds a certain temperature. When the temperature of the mechanical component upon which the thermal fuse device 350 is mounted exceeds the predetermined temperature, the spring-loaded mechanical plunger 352 may be released such that it extends into contact with the electric switch 354. The electric switch 354 may send an electric signal to the controller located outside the housing 22 in response to being tripped by the mechanical plunger 352. Although the temperature sensor assembly 18 of FIG. 9 does not take continuous temperature measurements throughout pump operation, the assembly 18 may still provide a signal indicative of the temperature of the connecting rod 76 (or crosshead) to the controller, as the signal from the switch 354 indicates that the temperature of the connecting rod 76 (or crosshead) has exceeded the predetermined temperature threshold. Multiple thermal fuse devices 350 and associated spring-loaded mechanical plungers 352 may be utilized in the pump power end 14 and positioned such that they take measurements of different points around the connecting rod 76 (or crosshead) for redundancy.

Figure 10:
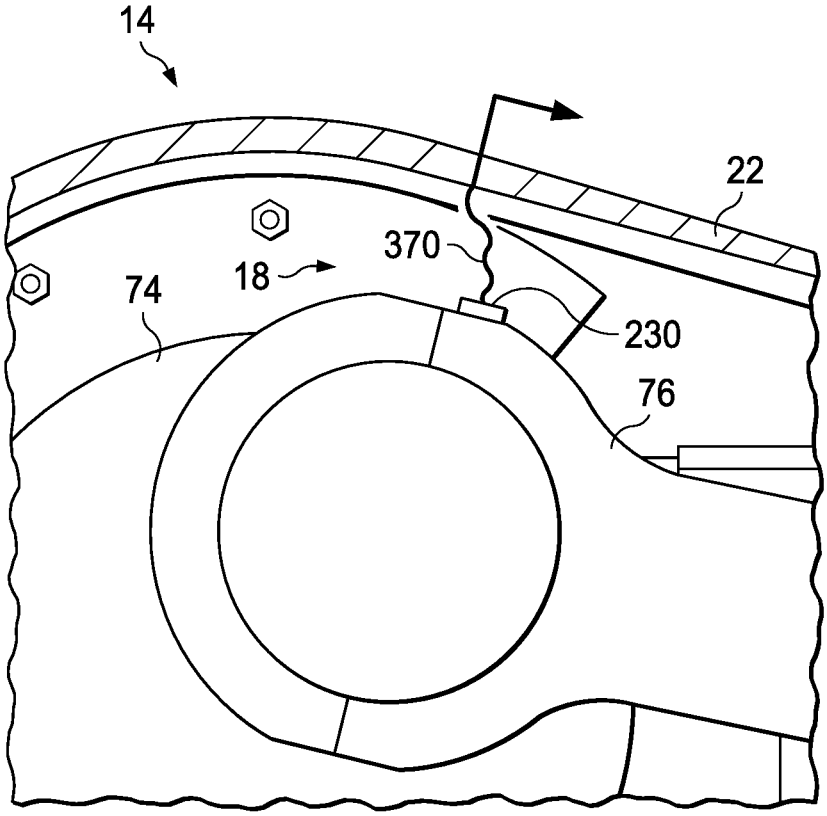
FIG. 10 is a diagram illustrating a sensor arrangement for monitoring bearing health in a pressure pump power end, in accordance with an embodiment of the present disclosure.

FIG. 10 illustrates an example temperature sensor assembly 18 having a temperature sensor 230 and a flexible cable 370. The temperature sensor 230 may be mounted directly to the connecting rod 76 (or crosshead) and connected to the housing 22 using the flexible cable 370. That is, the flexible cable 370 may be mounted to the housing 22 at one end and coupled to the temperature sensor 230 at the opposite end. The flexible cable 370 may include electrical communication of power and data between the temperature sensor 230 and components (e.g., controller, power source) located outside of the housing 22. The cable materials and techniques for connecting the flexible cable 370 to the housing 22 and the sensor 230 may be selected to minimize failure associated with bending of the cable 370 and oil spray expected to be encountered in the pump power end 14. Multiple temperature sensors 230 and associated flexible cables 370 may be utilized in the pump power end 14 and positioned such that they take measurements of different points around the connecting rod 76 (or crosshead) for redundancy.

Figure 11:
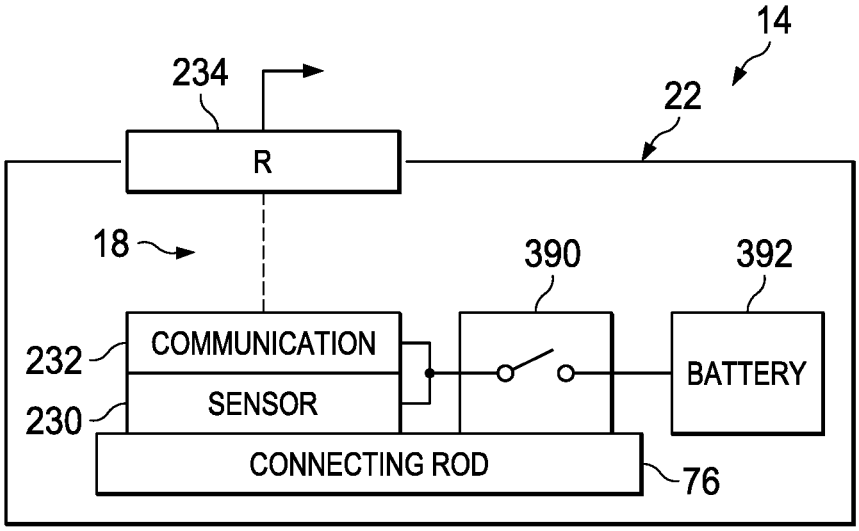
FIG. 11 is a diagram illustrating a sensor arrangement for monitoring bearing health in a pressure pump power end, in accordance with an embodiment of the present disclosure.

FIG. 11 illustrates an example temperature sensor assembly 18 having a temperature sensor 230, a wireless transmitter 232, a wireless receiver 234, a mechanical switch device 390, and a battery 392. The temperature sensor 230 may be mounted directly onto the connecting rod 76 (or the crosshead). The temperature sensor 230 may be coupled to or packaged together with the wireless transmitter 232, and the transmitter 232 may be designed to transmit temperature data collected by the temperature sensor 230 to the wireless receiver 234 via a wireless communication protocol. The wireless receiver 234 may be disposed on the housing 22 of the pump power end 14 so as to communicate signals received from the temperature sensor 230 and transmitter 232 inside the housing 22 to the controller located outside the housing 22.

The transmitter 232 and the temperature sensor 230 may be selectively coupled to the battery 392 via the mechanical switch device 390. The mechanical switch device 390 may operate similar to a thermostat such that when the connecting rod 76 (or crosshead) reaches a certain temperature, it moves a lever to electrically couple the temperature sensor 230 and the transmitter 232 to the battery 392. That way, the temperature sensor assembly 18 may only provide temperature measurements to the outside controller once the internal power end temperatures are within a certain range where bearing operation may be compromised. When a bearing is replaced or other maintenance is performed on the pump power end 14, an operator may reset the mechanical switch device 390 to decouple the sensor 230 and transmitter 232 from the battery 392. That way, a simple coin operated battery 392 may be used to provide sensing power in the pump end 14 throughout the lifecycle of the pump. Multiple temperature sensors 230 and associated transmitters 232, receivers 234, mechanical switch devices 390, and batteries 392 may be utilized in the pump power end 14 and positioned such that they take measurements of different points around the connecting rod 76 (or crosshead) for redundancy.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a housing enclosing a pump power end;

a crankshaft disposed in the housing;

a connecting rod enclosed within the housing, wherein the connecting rod comprises a first end coupled to the crankshaft;

a crosshead enclosed within the housing, wherein the crosshead is coupled to a second end of the connecting rod opposite the first end; and a temperature sensor assembly at least partially disposed on the housing, wherein the temperature sensor assembly is communicatively coupled to a controller located outside the housing, and wherein the temperature sensor assembly is positioned such that the temperature sensor assembly detects a temperature of the connecting rod or the crosshead;

wherein the temperature sensor assembly comprises an infrared sensor mounted to the housing, wherein a wavelength of electromagnetic energy transmitted from the infrared sensor is tuned to a type of lubricating oil on the connecting rod or crosshead.

2. The system of claim 1, further comprising the controller and a user interface coupled to the controller for outputting alerts when a detected temperature of the connecting rod or the crosshead exceeds a predetermined threshold.

3. The system of claim 1, wherein the temperature sensor assembly further comprises a second infrared sensor mounted to the housing on an opposite side of the connecting rod or crosshead from the infrared sensor.

4. The system of claim 1, further comprising a target material disposed on the connecting rod or the crosshead for detection by the infrared sensor.

5. The system of claim 4, wherein the target material comprises material that emits or reflects energy at wavelengths capable of passing through the type of lubricating oil on the connecting rod or crosshead.

6. The system of claim 1, further comprising a position sensor communicatively coupled to the controller and disposed on the pump power end to detect a position of the crankshaft.

7. A method, comprising:

transferring rotational movement from a crankshaft into reciprocating motion of a crosshead via a connecting rod coupled between the crankshaft and the crosshead, wherein the crankshaft, connecting rod, and crosshead are disposed within a housing of a pump power end;

detecting a temperature of the connecting rod or the crosshead via a temperature sensor assembly disposed at least partially on the housing, wherein the temperature sensor assembly comprises an infrared sensor mounted to the housing, wherein a wavelength of electromagnetic energy transmitted from the infrared sensor is tuned to a type of lubricating oil on the connecting rod or crosshead;

outputting a sensor signal from the temperature sensor assembly to a controller located outside the housing; and alerting an operator via a user interface coupled to the controller when the detected temperature of the connecting rod or crosshead exceeds a predetermined threshold.

8. The method of claim 7, further comprising:

detecting the temperature of the connecting rod or the crosshead over a period of time;

continually outputting sensor signals to the controller over the period of time; and storing trend data representative of the sensor signals in a database.

9. The method of claim 7, further comprising detecting a rotational position of the crankshaft, and determining a bearing in the pump power end that is malfunctioning based on the detected rotational position and the detected temperature.

10. The method of claim 7, further comprising comparing sensor signals received from the temperature sensor assembly to sensor signals received from a second temperature sensor assembly disposed in the pump power end.

11. The method of claim 7, further comprising comparing sensor signals received from the temperature sensor assembly to sensor signals received from a second temperature sensor assembly disposed in a second pump power end.

12. The method of claim 7, further comprising detecting a temperature of the connecting rod or the crosshead via a second temperature sensor assembly disposed on an opposite side of the connecting rod or crosshead from the temperature sensor assembly.

13. The method of claim 7, wherein detecting the temperature of the connecting rod or the crosshead comprises detecting a temperature of a layer of the lubricating oil on the connecting rod of the crosshead.

14. The method of claim 7, wherein detecting the temperature of the connecting rod or the crosshead comprises receiving energy reflected or emitted from a target material disposed on the connecting rod or crosshead.

15. The method of claim 14, wherein the target material comprises material that emits or reflects energy at wavelengths capable of passing through the type of lubricating oil on the connecting rod or crosshead.

16. A method, comprising:

transferring rotational movement from a crankshaft into reciprocating motion of a crosshead via a connecting rod coupled between the crankshaft and the crosshead, wherein the crankshaft, connecting rod, and crosshead are disposed within a housing of a pump power end;

detecting a temperature of the connecting rod or the crosshead via a temperature sensor assembly disposed at least partially on the housing;

outputting a sensor signal from the temperature sensor assembly to a controller located outside the housing;

detecting a rotational position of the crankshaft;

alerting an operator via a user interface coupled to the controller when the detected temperature of the connecting rod or crosshead exceeds a predetermined threshold; and determining a bearing in the pump power end that is malfunctioning based on the detected rotational position and the detected temperature.

17. The method of claim 16, wherein the temperature sensor assembly comprises an infrared sensor mounted to the housing.

18. The method of claim 16, wherein the temperature sensor assembly comprises a contact temperature sensor disposed at a distal end of a flexible member or spring-loaded plunger mounted to and extending from the housing.

19. The method of claim 16, wherein the temperature sensor assembly comprises a mechanical plunger mounted to the connecting rod or crosshead via a material that breaks down at a predetermined temperature to release the mechanical plunger toward a switch on the housing.

20. The method of claim 16, wherein the temperature sensor assembly comprises a temperature sensor directly coupled to the connecting rod or crosshead.

* * * * *